United States Patent [19]

Germann

[11] Patent Number: 4,789,263

[45] Date of Patent: Dec. 6, 1988

[54] PROCESS FOR THE PRODUCTION OF A BALL-POINT PEN TIP SUPPLIED WITH LIQUID INK, AND TIP PRODUCED THEREBY

[75] Inventor: Werner Germann, Lugano-Cassarate, Switzerland

[73] Assignee: Albe S.A., Agno, Switzerland

[21] Appl. No.: 622,396

[22] Filed: Jun. 20, 1984

Related U.S. Application Data

[63] Continuation of Ser. No. 384,082, Jun. 1, 1982, abandoned.

[30] Foreign Application Priority Data

Jun. 1, 1981 [CH] Switzerland ..... 3580/81-5

[51] Int. Cl.[4] ..... B43K 15/00

[52] U.S. Cl. ..... 401/2.09; 40.1/199; 40.1/216; 40.1/219; 29/441.2

[58] Field of Search ..... 401/198, 199, 209, 216, 401/212, 219, 220; 29/441 R, 441 BP

[56] References Cited

U.S. PATENT DOCUMENTS 3,966,336 6/1976 Lotfallah ..... 401/209

4,139,313 2/1979 Hori ..... 401/199 XR 4,457,644 7/1984 Yokosuka ..... 401/199 XR

FOREIGN PATENT DOCUMENTS 2307620 8/1974 Fed. Rep. of Germany ..... 401/209

1509356 1/1968 France ..... 401/209

*Primary Examiner*—Steven A. Bratlie

*Attorney, Agent, or Firm*—Young & Thompson

[57] ABSTRACT

A slender tube (A) having an internal diameter of about 1 mm and a wall thickness of about 0.1 mm is used for the production of the tips of ball-point pens. After a cycle of combined linear and rotation-derived working steps, the tip has a front cross section (A') the internal diameter of which has been reduced to approximately the cross section of the ball (5); a central cross section (A''') the cross section of which corresponds to that of the original tube; and a rear cross section (A'') with a cross section larger than the preceding cross section (A'''). The seat (S) against which the ball (5) is supported consists of conical recesses. The seat (S) is traversed by an opening into which penetrates the end (3') of a needle-like part (3), which part effects the ink transfer from a reservoir (2) to the ball.

4 Claims, 3 Drawing Sheets

Figure 1:
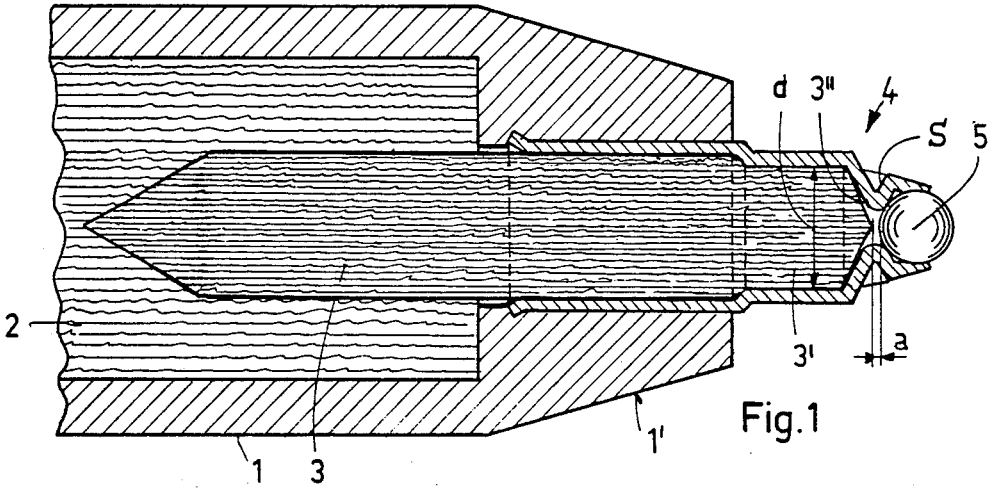
Figure 2A:
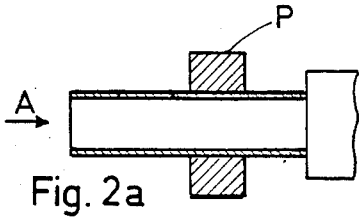
Figure 2F:
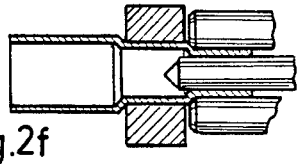
Figure 2B:
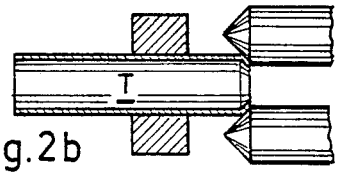
Figure 2G:
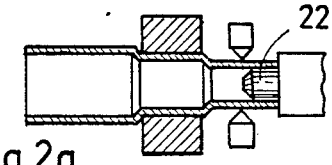
Figure 2C:
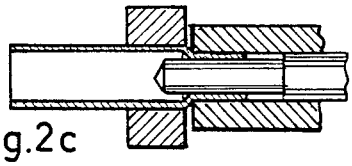
Figure 2H:
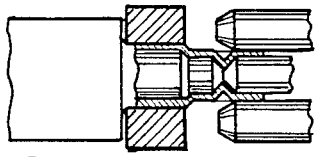
Figure 2D:
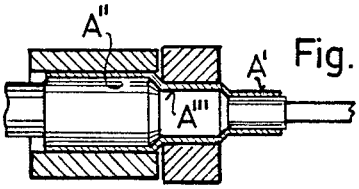
Figure 2I:
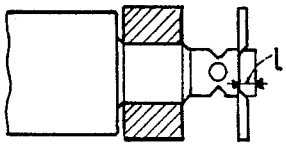
Figure 2E:
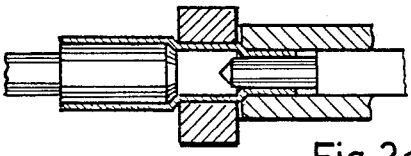
Figure 2K:
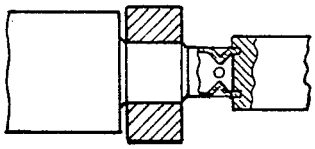

PROCESS FOR THE PRODUCTION OF A BALL-POINT PEN TIP SUPPLIED WITH LIQUID INK, AND TIP PRODUCED THEREBY

This application is a continuation, of application Ser. No. 384,082, filed June 1, 1982 now abandoned.

The invention relates to a process for the production of a ball-point pen tip supplied with liquid ink.

Furthermore, the invention concerns the ball-point tip produced in accordance with this process.

Ball-point pens with pasty ink are conventional. These exhibit the disadvantage frequently to form spots when writing is begun.

Also, felt-tip pens are known wherein the liquid ink is fed to the writing tip by means of a tampon or wad.

Furthermore, ball-point pens with liquid ink are known (see, for example, Swiss Patent No. 351,188) wherein the ink is supplied in the direction of the ball by means of a wad consisting of a fibrous material and subsequently to a pointed part consisting of fibers and enclosed by a nonporous tubelet.

However, these pens have the disadvantage that the ink delivery is frequently arrested; consequently, air enters between ink and ball, and continued writing becomes impossible.

In this connection, a ball-point pen has been known from U.S. Pat. No. 3,960,455 having a metallic tip and able to accommodate two balls. In this arrangement, the past-like ink is fed conventionally, i.e. without the use of a storage means in the form of a wad and needle-like pin for the capillary feeding of the ink to the ball. According to U.S. Pat. No. 2,879,586, the tip consists of a tube portion with a strong wall and uniform cross section, this cross section corresponding to the ball diameter. The wall of the bearing location of the ball is not strengthened and not reduced at the same time.

German Patent No. 870,962 describes a ball-point pen for liquid ink with nubs as bearing means for the ball. In this pen, the path for feeding the ink to the ball, starting with the reservoir, is very long. The tip is only one diameter throughout, corresponding to that of the ball. The feeding of liquid ink to the ball described in Swiss Patent No. 562,106 is effected via a long duct; besides, the ball is supported in a plastic tip. The tip according to DOS [German Unexamined Laid-Open Application] No. 2,701,694 consists of plastic material. The needle-like tip terminates quite a distance from the ball. Here, the ink is furthermore accumulated. In this arrangement, the danger of taking in air and consequently cessation of ink supply to the ball is very great. Finally, DOS No. 3,000,214 describes a tip having a tubular part of metal which is generally cylindrical and manufactured with a cross section which is the same throughout.

The bearing for the ball is not strengthened and, at the same time, is designed with a reduced wall. Besides, the feeding duct corresponds to the diameter of the ball and therefore is extremely small, in such a way that feeding of the ink with a fibrous stub into the close proximity of the ball is impossible.

The present invention has as its subject a tip for ball-point pens of this last-mentioned type wherein these disadvantages are avoided.

A preferred embodiment of the invention will be described in greater detail below with reference to the appended drawings.

Figure 3:
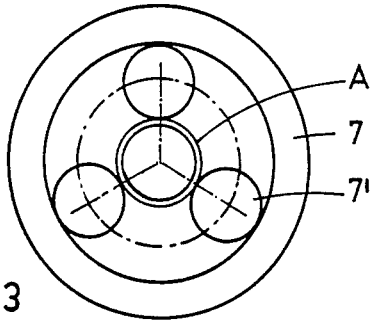
Figure 4:
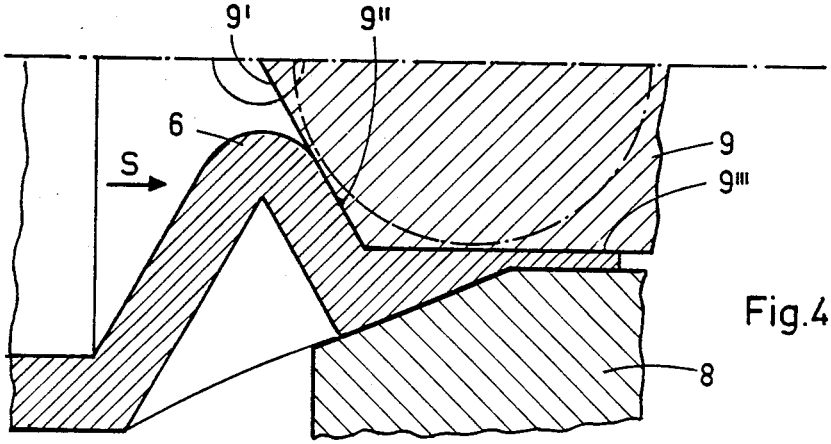
Figure 5:
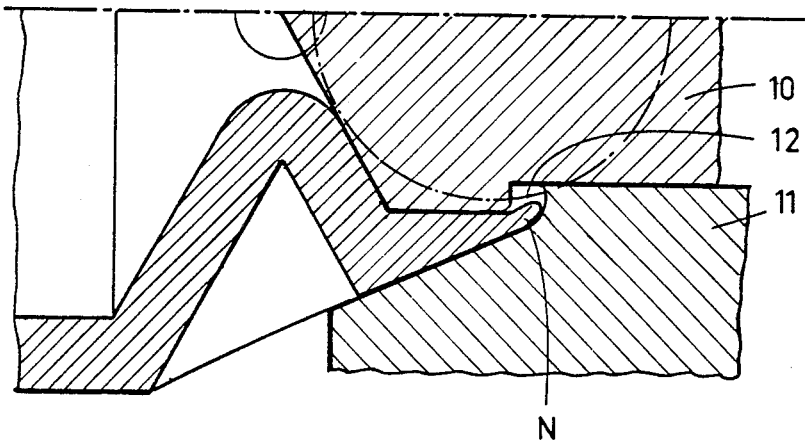
Figure 6:
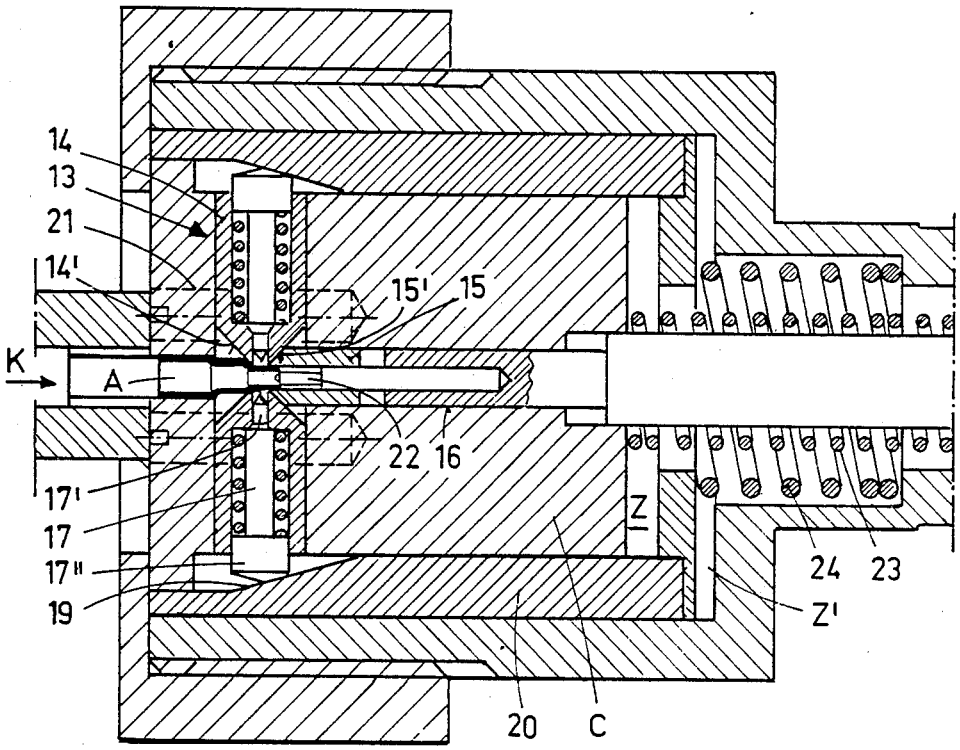
Figure 7:
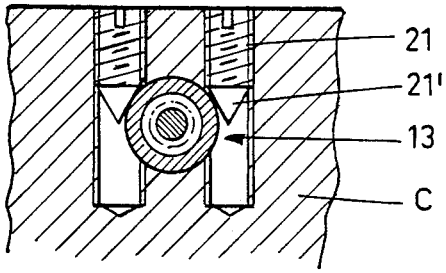

FIG. 1 shows schematically a section on an enlarged scale of the front portion of a ball-point pen, FIGS. 2*a*–2*k* are schematic views of the succession of working steps for producing the tip, starting with a cylindrical tubelet, FIG. 3 shows the working principle for a device for forming the tubelet by a rolling process, FIG. 4 shows how the forward portion of the tip is brought to an exact dimension, FIG. 5 shows, on an enlarged scale, how the annular mounting of the ball is produced, FIG. 6 shows the axial section through a tool for forming the ball seat, on an enlarged scale, FIG. 7 is a partial sectional view of a unit for making a recess serving as the ball seat.

Referring to the drawings, the tip is made from a tubelet commercially known as "microtube", and utilized, for example, for the manufacture of hollow needles for syringes, catheters, and the like.

This type of tube is obtained starting with a metal strip, especially of corrosion-resistant rolled steel, which is rolled up and welded together in the longitudinal direction. The thickness of the strip is about 0.1 mm, and the internal diameter of the unfinished tube offered on the market is about 1 mm.

FIG. 1 shows schematically the tip of a ball-point pen according to this invention, fed with liquid ink. Numeral 1 denotes the external cylindrical member with the tapered portion 1' on the side of the ball.

The member 1 contains a small cylinder or wad 2 of felt or a spongy material of a conventional type, fulfilling the task of an ink reservoir. The ink is of the kind utilized in conventional fountain pens wherein the fluidity is not particularly subject to the effects of temperature differences.

A cylindrical or needle-shaped part 3, consisting of fibers of a synthetic resin or equivalent material is introduced by frictional mounting in the forward end zone of this member 1. This part 3 likewise has a circular cross section, the end zone 3' of this part being designed in the direction toward the ball preferably with a reduced, circular cross section.

The tip 4, equipped with the ball 5, is introduced into the tapering, forward end zone 1' of the member 1. The ink absorbed by the wad 2 is fed to the ball by means of the needle-shaped part 3 by capillary action.

As can be seen from FIG. 1 on an enlarged scale, the needle-like part 3 extends with its end zone 3' into the very close proximity of the ball 5. The spacing "a" is very small, i.e. is designed so that the fibers are prevented from touching the ball and/or so that the fibers cannot pass in between the ball surface and bearing seat S of the ball.

Advantageously, the spacing "a" is smaller than $\frac{3}{4}$ of the ball diameter.

Thus, according to the invention, the end face 3'' of the needle-shaped part 3, i.e. the surface effecting the efflux of a plurality of liquid filaments from the needle-shaped part, is extended up into the seat S of the ball, which latter seat will be explained in greater detail below.

Still with reference to FIG. 1, the internal diameter d of the end zone 3' of the needle-like part 3 is chosen to be maximally large with reference to the ball diameter.

Consequently, a large amount of capillary ducts for conducting the ink and for storing the liquid supplied by the wad 2 to the needle-like part 3 is transported into the close proximity of the associated spherical surface of the ball 5.

The diameter of the needle-like part is likewise made to be maximally large.

Advantageously, the path traversed by the fluid in the needle-like part is selected to be short.

This ensures that ink is supplied to the ball taken in by the needle-like part on account of capillary action, the associated spherical ball surface being constantly wetted by the ink collecting between the forward surface zone 3" and the ball.

On account of the rotation of the ball, i.e. when the latter is in contact with the writing paper, the entire surface of the ball is wetted, and ink is continuously transferred to the paper.

The needle-like part 3 therefore fulfills a very important function. Actually, the features of its configuration and the material used for its manufacture are chosen so that the transporting of the ink to the ball takes place in an uninterrupted fashion and in the required quantity, in correspondence with the writing intensity.

If the ink supply should be inadequate and such that it does not correspond to the prevailing requirement, then an interruption would entail a taking in of air, and thus the ink delivery would come to a halt.

FIG. 2 shows the various processes, i.e. the succession of the operating steps ensuring the manufacture of the tip according to this invention.

The operating steps ensuring respectively the retaining of the respective tube portion with the aid of a vise P are the following:

(a) Separating the tube portion of steel, advantageously corrosion-resistant steel [stainless steel], and deburring of the edges of the two end faces, (b) Tapering, by rolling of the end zone, the forward portion of the tubelet for mounting of the ball, a plunger T being introduced into the rearward part of the tubelet and being moved up to the tapered portion being formed, (c) Reducing, by radial rotating and rolling, the previously tapered forward portion of the tubelet, the longitudinal axis of the forward portion being maintained so that it is coaxial to the residual portion of the tubelet, (d) Widening the rearward portion of the tubelet, wherein the internal diameter and the external diameter of the tube section lying between the forward portion and the rearward portion correspond at least approximately to the original diameter, (e) Bringing the cylindrical bores pertaining to the forward and rearward portions of the tubelets to an exact dimension, (f) Simultaneous rolling of the forward portion of the tubelet from the inside and from the outside by means of a tool called a "triplet" with resultant reduction in wall thickness and lengthening of the portion, (g) Producing the ball seat with the aid of centrally acting plungers with conically formed point, the ball seat consisting of indentations, the apex of which extends in the direction of the tubelet axis, and subsequently equalizing the bearing points for the ball with the aid of a plunger acting coaxially to the axis of the tubelet, (h) Bringing the external end zone of the tubelet, especially the part located in front of the ball seat, to an accurate dimension simultaneously from the inside and from the outside with the aid of a tool called a "triplet", wherein for this working step the peg or stud for the calibrating operation from the inside is centered with respect to the locations representing the ball seat, (i) Separating the end 1 of the forward portion which has become superfluous on account of the preceding machining steps performed on the tubelet, (k) Producing the marginal zone or circular ring for the subsequent supporting of the ball, (l) Flanging the edge zone toward the inside, (m) Introducing the ball by snapping in place with the aid of the resilient, annular bent portion in the outermost zone of the tip (not shown in the drawings).

Thus, regarding the succession of working steps for producing the tip, a tubelet having an extremely thin wall thickness is the starting component; this tubelet is reduced in the forward portion by cold forming until the internal dimension comes close to the diameter of the ball; then the rearward end zone, i.e. the zone opposed to the forward portion, is widened until an internal cross section has been reached capable of accommodating part of the needle-shaped member, ensuring that the latter can extend into the close proximity of the ball; in this procedure, the part A''' interposed between the forward portion A' and the rearward portion A'' retains its original cross section.

The forming operations, especially regarding the forward portion of the tubelet, have the purpose, in addition to establishing the required internal diameter for receiving the ball, also of strengthening and reducing the original wall thickness thus to facilitate the recessing and to ensure the elastic resilience of the edge zone necessary to snap the ball in place. This precludes a premature wear of the entire bearing surface for the ball, in that the material is provided with the required hardness.

This combination of narrowing and widening of the opposed portions of a tubelet with respect to a central dimension of the latter, as well as the establishment of a centrally arranged passage defined by a plurality of conically configured indentations as a seat for the ball and, finally, the reduction of the forward wall thickness for supporting the ball, are the basic features of the tip according to this invention. This tip is thus realized essentially by cold forming rather than by a metal-cutting operation. As can be seen from FIG. 1, the said centrally arranged passage defined by said indentations has a least diameter that is greater than the distance "a". Moreover, the needle-shaped member tapers to a point adjacent the ball, this point being disposed in said centrally arranged passage.

The number of recesses 6 as supporting means, forming the seat S for the ball 5, is advantageously 3, 4, or 5, in dependence on the size of the ball diameter. If, for example, the ball diameter is larger than 0.6 mm, five recesses are provided, while, with a smaller diameter than 0.8 mm ball diameter, the number of recesses will limit itself to four, in the limit case to three.

The tool known as "triplet", the use of which has been known in numerous branches of industry for cold forming, comprises (FIG. 3) a cylindrical jacket 7 with shank. Within the jacket 7, three rollers 7' are arranged to be rotatable about their own axes and in parallel to the axis of the cylinder; these rollers, in turn, press against the wall of the tubelet A being formed. FIG. 4 shows, based on FIG. 2*h*, on an enlarged scale how, after the seat S has been produced, the end zone of the forward portion A' of the tubelet is once again brought to an exact dimension. In this arrangement, 8 denotes part of an outer roller and 9 is a concentrically arranged pin which, with its apex 9', presses against the zone of the recess 9'' which is to constitute the support for the ball. At the same time, pressure is also exerted on the cylinder wall 9''', ensuring an extremely accurate centering of the ball seat S with respect to the axis of the tubelet and, in particular, with respect to the wall 9''' which will encompass the ball.

For forming the annular mounting N (FIG. 5), an external "triplet" is provided in addition to a pin 10, which latter is concentric with the axis of the tubelet and simultaneously with the axis of the seat S. The external rollers 11 of this external "triplet" exhibit a groove 12 to bend the annular rim N inwardly, in order to attain a minimum radial dimension as required for the introduction of the ball 5 by snapping same in place, i.e. with the aid of an elastic resilience of the rim.

For producing the seat S for the ball 5 (FIG. 2g), the tool shown on an enlarged scale in FIG. 6 is utilized. This figure shows a tubelet A arranged axially to the tool and two coaxially arranged plunger units 13, located in a vertical plane. Each unit 13 comprises a hollow member 14 which tapers conically at the front and close to the axis of the tool. The additional taper 15' of a bushing 15 presses against the taper 14', this bushing being located coaxially to the aforementioned tip 4 and being detachably mounted in the central bore 16. The bushing 15 has the purpose of determining the combined position of the units 13 in a plane perpendicular to the axis of the tubelet A. A plunger 17 with a pointed front part 17' is arranged to be axially displaceable in the hollow member 14. The opposite, outer end 17'' of the plunger has a diameter larger than the shank, to guide the latter axially and in order to form a support for a pretensioned coil compression spring. The outer end 17'' furthermore acts as a plunger and is acted upon by the conical surface 19. The conical surface 19 pertains to the inner wall of a bushing 20, which latter is coaxially displaceable with respect to the axis of the tip to be machined.

The units 13 are engaged by the conically fashioned end zones 21' of two screws 21. These are arranged in parallel to the axis of the tool and effect the alignment of the corresponding axes of the units 13 so that these axes intersect with the axis of the tool.

When the recesses are produced, and on account of the displacement of the bushing 20, a calibrating plunger 22 enters into the tubelet. The depth of the recesses S and the displacement distance of the plunger 22 are limited by the corresponding displacements Z and Z' executed by the member C and by the bushing 20. The compressive force K is exerted on the member C; the member C and the bushing 20 are, in turn, pretensioned by the springs 23 and 24.

What is claimed is:

1. Process for the production of a ball-point pen tip to be supplied with liquid ink by means of a capillary member said tip comprising reservoir means (2) for feeding ink to a ball (5) by means of a porous, needle-like part (3), that emerges from a tubular section of predetermined length, said process comprising forming coaxially on a slender cylindrical metal tube a forward end zone (A') of reduced diameter relative to the original tube, a rearward end zone (A'') of enlarged diameter relative to the original tube, and a central zone (A''') of substantially the original diameter of the tube, then reducing by simultaneous rolling from inside and outside the wall thickness of said forward end zone (A') by using a plurality of rollers on the outside of said forward end zone, flanging said end zone (A') of reduced thickness inwardly, and snapping said ball (5) into the flanged forward end zone.

2. Process according to claim 1, in which a tubular portion of steel tubing from an indeterminate length of steel tubing is separated and deburred at the edges of the two ends of the separated tube portion, comprising the following operations:

(a) tapering the forward end of the tube portion by rolling while disposing a plunger (T) in the rear of said tube portion;
(b) reducing by radial rotating and rolling, the forward portion (A') of the tube portion;
(c) widening the rearward portion (A'') of the tube portion (A) while maintaining the internal and external diameter of the central zone (A''') in its original diameter;
(d) reducing the wall thickness of said forward portion (A') by simultaneous rolling from inside and outside using three rollers on the outside of said forward portion;
(e) pressing radially inwardly with a plurality of plungers with conically formed points, at spaced locations about said forward portion (A') thereby to form therein a plurality of spaced recesses (6);
(f) inserting a plunger into the outer end of the forward portion (A') to equalize the bearing points for the ball by deforming at least one of said recesses (6);
(g) separating the outer end of the forward portion (A');
(h) flanging inwardly the end edge of the remaining forward portion (A'); and
(i) snapping a ball into the forward end.

3. Process according to claim 1, in which said forward end zone (A') of reduced diameter relative to the original tube is formed by tapering the forward end of said slender cylindrical tube while disposing a plunger in the rear thereof, and then producing by radial rotating and rolling said forward end zone on the tapered forward end thus produced.

4. A ball point pen tip produced by the process of claim 1.

* * * * *